US009453341B1

(12) United States Patent
Swierad et al.

(10) Patent No.: US 9,453,341 B1
(45) Date of Patent: Sep. 27, 2016

(54) WALL SYSTEM HAVING CORE SUPPORTING BLOCKS AND DECORATIVE FASCIA BLOCKS

(71) Applicant: HENGESTONE HOLDINGS, INC., Toronto, Ontario (CA)

(72) Inventors: Scott Swierad, Calendon (CA); Ray Rodenburgh, Rockwood (CA); Aaron Bailey, Bowmanville (CA)

(73) Assignee: HENGESTONE HOLDINGS, INC., Toronto, Ontario (CA)

( * ) Notice: Subject to any disclaimer, the term of this patent is extended or adjusted under 35 U.S.C. 154(b) by 0 days.

(21) Appl. No.: 14/829,067

(22) Filed: Aug. 18, 2015

(51) Int. Cl.

| | |
|---|---|
| ***E04F 13/00*** | (2006.01) |
| ***E04C 1/39*** | (2006.01) |
| ***E04B 2/02*** | (2006.01) |
| ***E04B 2/08*** | (2006.01) |
| ***E04B 1/04*** | (2006.01) |
| ***E02D 29/02*** | (2006.01) |
| ***E01F 8/00*** | (2006.01) |

(52) U.S. Cl.
CPC ..... *E04C 1/395* (2013.01); *E01F 8/0005* (2013.01); *E02D 29/025* (2013.01); *E02D 29/0266* (2013.01); *E04B 1/043* (2013.01); *E04B 2/02* (2013.01); *E04B 2/08* (2013.01); *E04C 1/397* (2013.01); *E04B 2002/0236* (2013.01)

(58) Field of Classification Search
CPC ..... E04C 1/395; E04C 1/397; E01F 8/0005; E02D 29/025; E02D 29/0266; E02D 29/02; E04B 1/043; E04B 2/08; E04B 2002/0236; E04B 2/02; E04B 2/40; E04B 2/32; E04B 2/18; E04B 2/16; E04B 2002/0206
USPC ..... 52/604, 612; 405/284, 286
See application file for complete search history.

(56) References Cited

U.S. PATENT DOCUMENTS

| | | | | | |
|---|---|---|---|---|---|
| 658,869 | A | | 10/1900 | Rosenbaum | |
| 776,441 | A | * | 11/1904 | Veyon | E04C 1/42 428/13 |
| 833,736 | A | | 10/1906 | Fenn | |
| 1,707,347 | A | | 4/1929 | Dunbar | |
| 1,805,334 | A | | 5/1931 | Kelly | |
| 1,946,125 | A | | 2/1934 | Bennett | |
| 2,066,268 | A | | 12/1936 | Hohner | |
| 2,392,551 | A | * | 1/1946 | Roe | E04B 2/08 52/309.17 |
| 4,478,021 | A | * | 10/1984 | Person | B28B 15/00 52/309.7 |
| 4,803,821 | A | | 2/1989 | Funaki | 52/387 |
| 4,856,246 | A | | 8/1989 | Shimasaki | 52/386 |

(Continued)

FOREIGN PATENT DOCUMENTS

| | | | | |
|---|---|---|---|---|
| CA | 2244348 | C | 7/1998 | E02D 29/02 |

*Primary Examiner* — Beth Stephan
(74) *Attorney, Agent, or Firm* — Kusner & Jaffe

(57) ABSTRACT

A wall system comprising: a plurality of core blocks, each core block having: a front face; a rear face; a top face; a bottom face; a left side face; and a right side face, each core block having protrusions and grooves in one of the top and bottom faces for interlocking together an assembly of core blocks in stacked rows with abutting side faces, each core block having a slip molding axis and a substantially uniform cross-sectional profile transverse to the slip molding axis, wherein the front, rear, top and bottom faces define the cross-sectional profile; a plurality of fascia blocks, each fascia block having: a decorative exposed front face; a rear face; a top face; a bottom face; a left side face; and a right side face; and a plurality of connectors for mounting the fascia blocks to the assembly of core blocks.

18 Claims, 18 Drawing Sheets

(56) References Cited

U.S. PATENT DOCUMENTS

| | | | | | |
|---|---|---|---|---|---|
| 4,860,505 | A | | 8/1989 | Bender | 52/98 |
| 4,890,433 | A | | 1/1990 | Funaki | 52/386 |
| 4,916,875 | A | | 4/1990 | Kashiwagi | 52/302 |
| 5,029,425 | A | | 7/1991 | Bogataj | 52/482 |
| 5,337,527 | A | * | 8/1994 | Wagenaar | E02D 29/025 405/284 |
| 5,465,544 | A | * | 11/1995 | Ghahary | B32B 21/08 156/61 |
| 5,788,423 | A | * | 8/1998 | Perkins | E02D 29/025 405/284 |
| 5,816,749 | A | * | 10/1998 | Bailey, II | E02D 29/0241 405/284 |
| 5,930,964 | A | * | 8/1999 | Boehning | E04C 1/41 52/309.1 |
| 6,000,183 | A | * | 12/1999 | Newman | E04F 13/0883 52/311.1 |
| 6,152,655 | A | * | 11/2000 | Hull | E02D 29/025 405/284 |
| 6,164,029 | A | | 12/2000 | Lee | 52/386 |
| 6,178,715 | B1 | | 1/2001 | Pacitto et al. | 52/604 |
| 6,240,693 | B1 | * | 6/2001 | Komasara | B26F 1/3846 52/439 |
| 6,289,647 | B1 | | 9/2001 | Sjolander | 52/510 |
| 6,758,636 | B2 | * | 7/2004 | Rainey | E02D 29/0225 405/262 |
| RE39,922 | E | | 11/2007 | Rainey | 405/262 |
| 7,410,328 | B2 | * | 8/2008 | Hamel | E02D 29/0266 405/262 |
| 7,617,646 | B2 | | 11/2009 | Losse | 52/385 |
| D621,075 | S | | 8/2010 | Haeussler | D25/140 |
| 8,234,828 | B2 | * | 8/2012 | MacDonald | E02D 29/02 52/386 |
| 8,313,267 | B2 | * | 11/2012 | Johnson | E04C 1/395 405/284 |
| 8,882,398 | B2 | | 11/2014 | Bender et al. | 405/286 |
| 2007/0166112 | A1 | | 7/2007 | Risi | 405/284 |
| 2007/0292216 | A1 | * | 12/2007 | Hamel | E02D 29/025 405/286 |
| 2008/0134615 | A1 | | 6/2008 | Risi et al. | 52/598 |
| 2008/0236084 | A1 | * | 10/2008 | Pontarolo | E04B 2/8647 52/426 |
| 2010/0018146 | A1 | * | 1/2010 | Aube | E02D 29/0233 52/483.1 |
| 2011/0072753 | A1 | * | 3/2011 | MacDonald | E02D 29/025 52/562 |
| 2014/0053493 | A1 | * | 2/2014 | Carey | E04C 1/24 52/604 |

* cited by examiner

WALL SYSTEM HAVING CORE SUPPORTING BLOCKS AND DECORATIVE FASCIA BLOCKS

FIELD OF THE INVENTION

The invention relates to wall system having a core of supporting blocks and an exterior of decorative fascia blocks mounted on a horizontal ledge on a vertical face of the core blocks.

BACKGROUND OF THE INVENTION

The construction of outdoor walls that match or complement adjacent pavement blocks or pavers has been a challenge due to the differences in manufacturing procedures and materials used. The manufacturing processes used for pavers can be expensive or not adaptable for large wall blocks. Since many landscaping projects include wall blocks and pavers assembled to build retaining walls, benches, bench walls, privacy walls, fences, fireplaces, masonry fences, masonry fence posts and paved areas, the integrity of the design dictates that similar finishes, colors and shapes be used for stacked wall blocks and pavers.

Wall blocks are stacked vertically in horizontal rows where the front face of an earth retaining wall is usually the only visible surface. For bench walls, masonry fences and masonry fence posts, both side surfaces and often the end surfaces of these structures are visible.

To minimize costs of materials and manufacturing, some designs use a low cost core block with a decorative higher cost fascia block mounted on the visible surfaces of the core blocks. The core blocks and fascia blocks are interlocked together with various connectors or molded dove-tailed tongue and groove elements. Examples are described in Canadian Patent 2244348 and US Patent Application Publication 2008/0134615. Accuracy of molding the concrete blocks and closely fitting tongue and groove elements is an impediment to manufacturing. Concrete shrinkage and slump after the molds are removed result in significant dimensional variations in the opposite direction of mold removal. Such dimensional variations create not only a poor visual appearance but make for installation difficulties as well.

There remains a demand for an economical easily constructed dual block wall system that ensures accurate assembly, cost efficiency, design flexibility, and matching of the exposed wall blocks with pavers.

Features that distinguish the present invention from the background art will be apparent from review of the disclosure, drawings and description of the invention presented below.

SUMMARY OF THE INVENTION

The invention provides a wall system comprising: a plurality of core blocks, each core block having: a front face; a rear face; a top face; a bottom face; a left side face; and a right side face, each core block having protrusions and grooves in one of the top and bottom faces for interlocking together an assembly of core blocks in stacked rows with abutting side faces, each core block having a slip molding axis and a substantially uniform cross-sectional profile transverse to the slip molding axis, wherein the front, rear, top and bottom faces define the cross-sectional profile; a plurality of fascia blocks, each fascia block having: a decorative exposed front face; a rear face; a top face; a bottom face; a left side face; and a right side face; and a plurality of connectors for mounting the fascia blocks to the assembly of core blocks, the connectors comprising: a horizontal ledge protruding from one of: the rear face of the fascia blocks; and the front face of the core blocks; and a matching horizontal recess in one of: the front face of the core blocks; and the rear face of the fascia. If required, when installed core blocks can create a continuous horizontal void or raceway for utility installation (electricity, water, audio/visual wires etc.).

BRIEF DESCRIPTION OF THE DRAWINGS

In order that the invention may be readily understood, an embodiment of the invention is illustrated by way of examples in the accompanying drawings.

FIG. 4(*b*) is a low batter angle; and FIG. 4(*c*) is a high batter angle. The selection of three positions is by way of example only and it will be apparent that any number of positions could be provided for by arranging grooves and ridges in various combinations.

Further details of the invention and its advantages will be apparent from the detailed description included below.

DETAILED DESCRIPTION OF PREFERRED EMBODIMENTS

Figure 1:
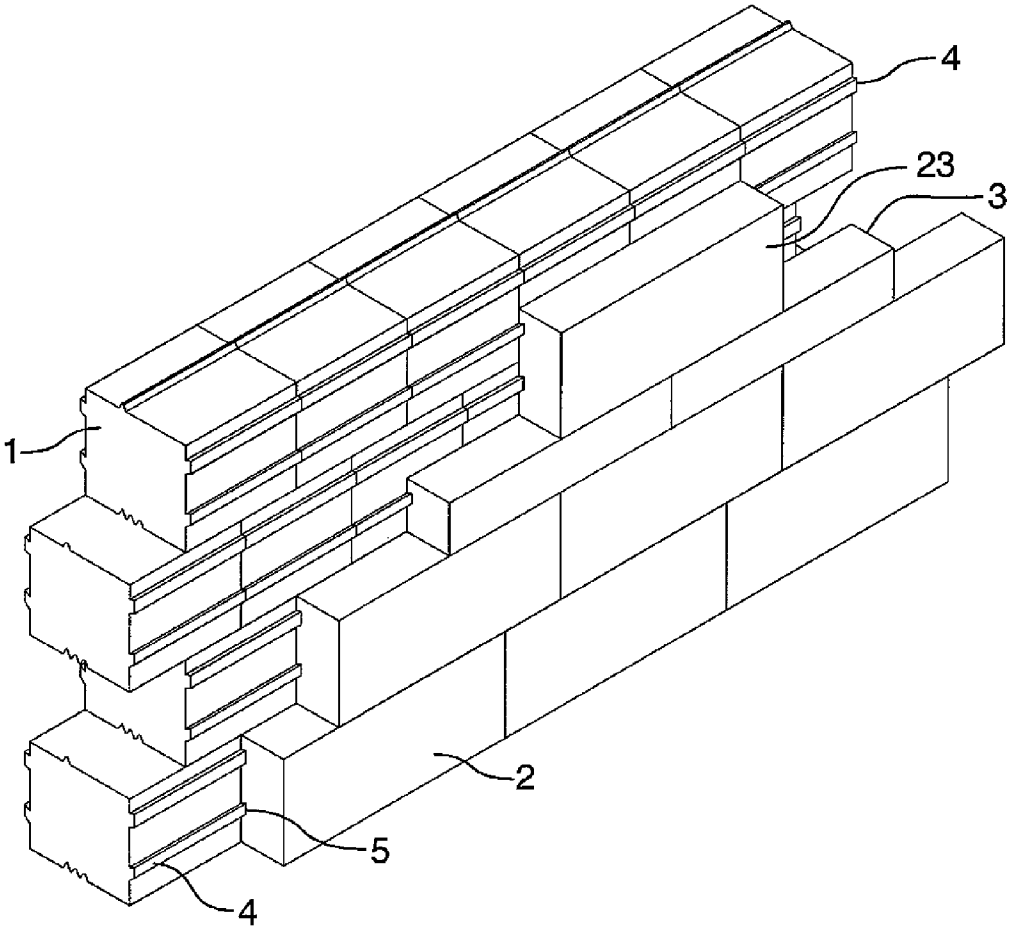
FIG. 1 is perspective view of an example wall, in accordance with an embodiment of the invention, constructed of solid core blocks and two sizes of fascia blocks each with a vertical exposed front face.

FIG. 1 shows an example wall with a vertical front face constructed of solid core blocks 1, wide fascia blocks 2, and thin fascia blocks 3. The general components of all example walls described herein include an assembly of solid core blocks 1 (in FIGS. 1-14), or hollow core blocks 6 (in FIGS. 15-20) with hollow channels, the core blocks 1, 6 being arranged in stacked rows with abutting vertical side faces, and fascia blocks 2, 3, 23 mounted on the core blocks 1 using interlocking ledges 4 and recesses 5.

Figure 2:
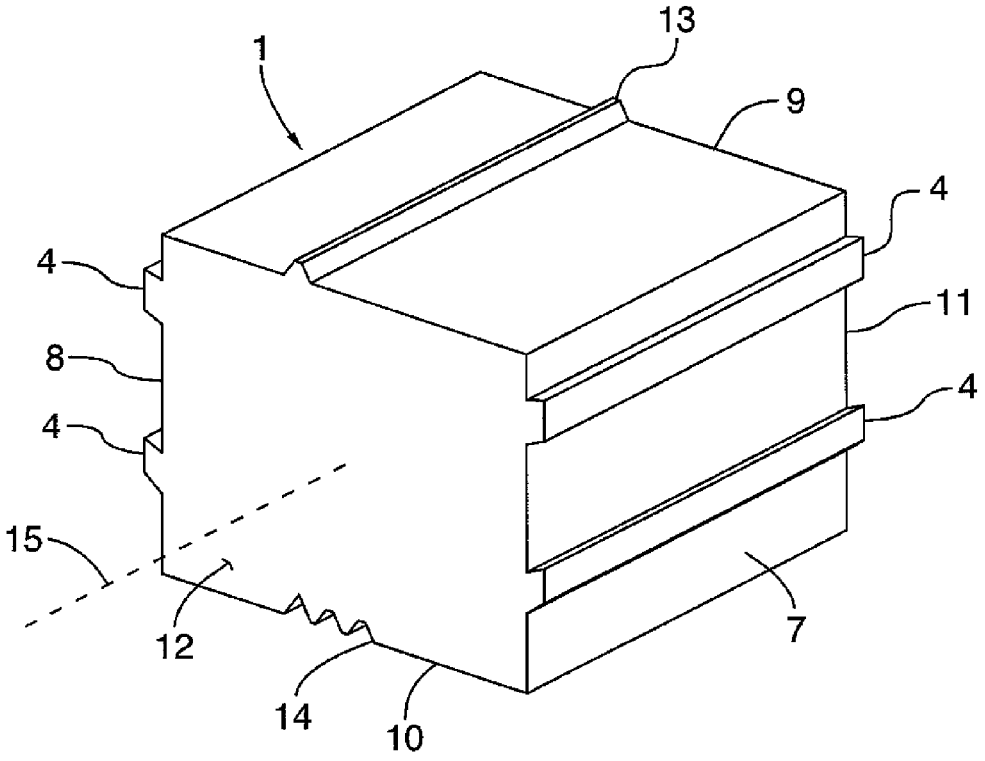
FIG. 2 is a perspective view of the solid core block of FIG. 1 having a single top ridge and three bottom grooves to enable a selection of three interlocked positions shown in FIGS. 4(*a*)-4(*c*).
Figure 10:
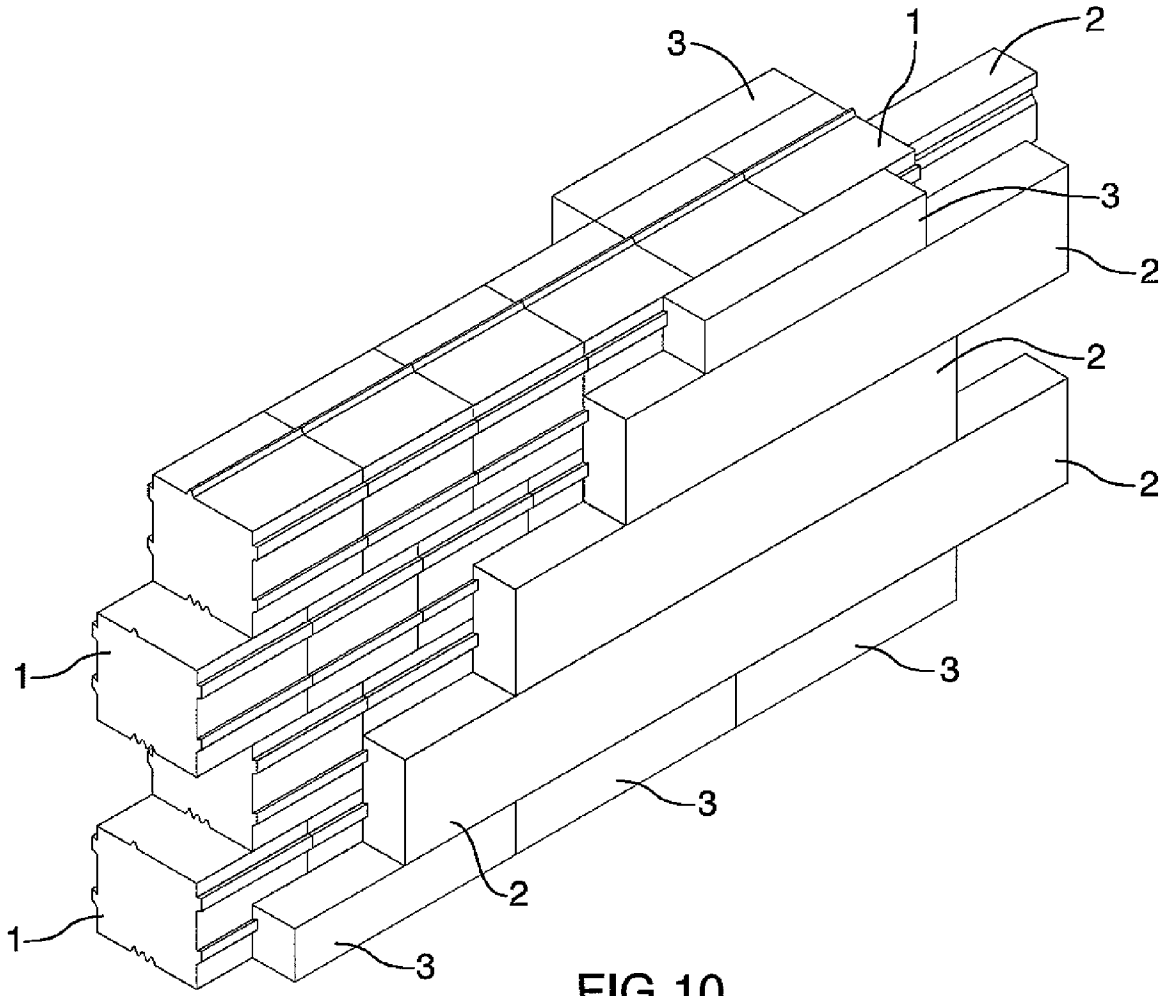
FIG. 10 is a perspective view of a two sided wall constructed vertically with solid core blocks and fascia blocks on both front and rear faces.
Figure 11:
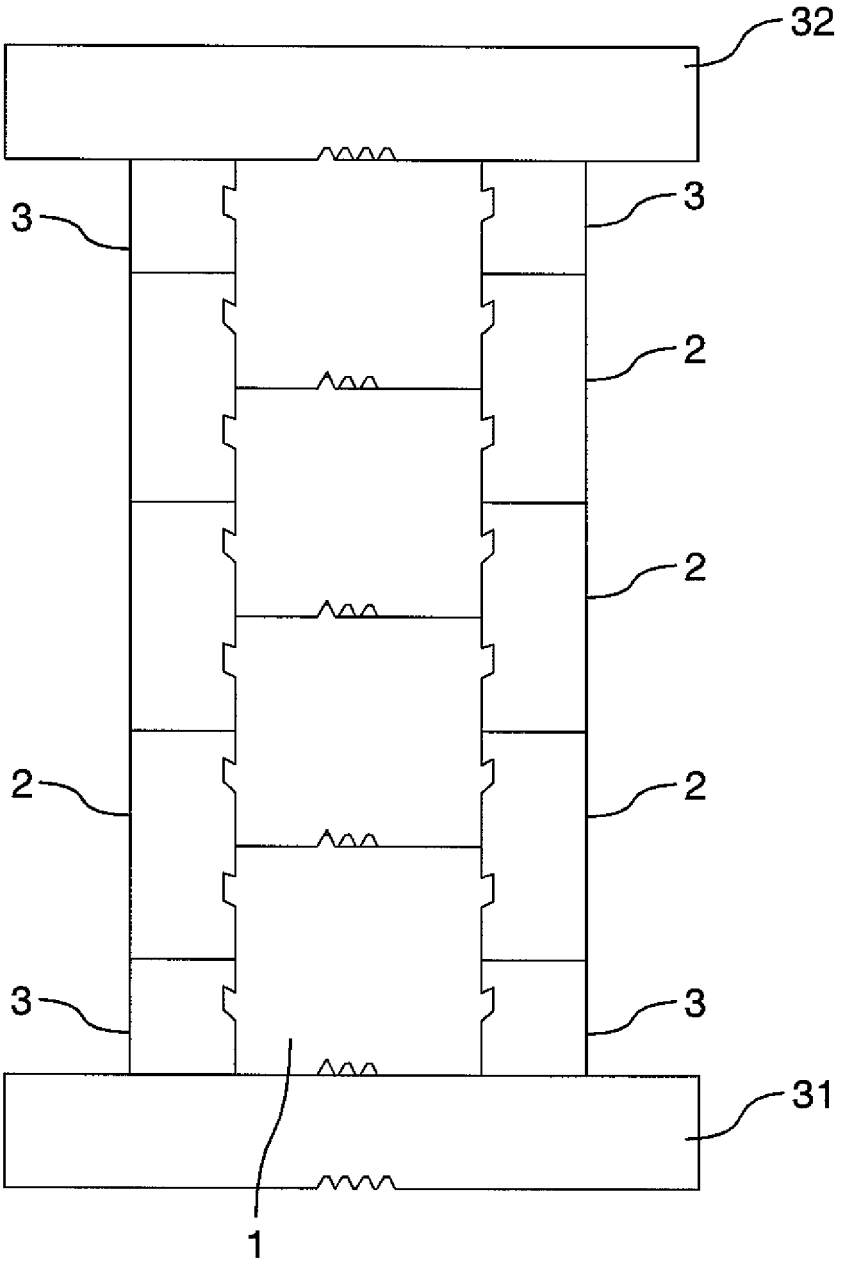
FIG. 11 is a vertical sectional view through the wall of FIG. 10 with a foundation block at the base and a coping block on the top.

FIG. 2 shows a first example solid core block 1 which is illustrated in assemblies of FIGS. 1-14. An alternative example of a hollow core block 6 is shown in FIGS. 15-20. Whether solid or hollow, the core blocks 1, 6 have common features. Referring to FIG. 2, each core block 1 has: a front face 7; a rear face 8; a top face 9; a bottom face 10; a left side face 11; and a right side face 12. In the example of FIG. 2, the core block 1 is symmetrical, apart from the interlocking protrusion 13 in the top face 9, and fascia blocks 2, 3, 23 can be mounted to both front and rear faces 7, 8, as seen in the example of FIGS. 10-11.

Figures 4A, 4B, 4C:
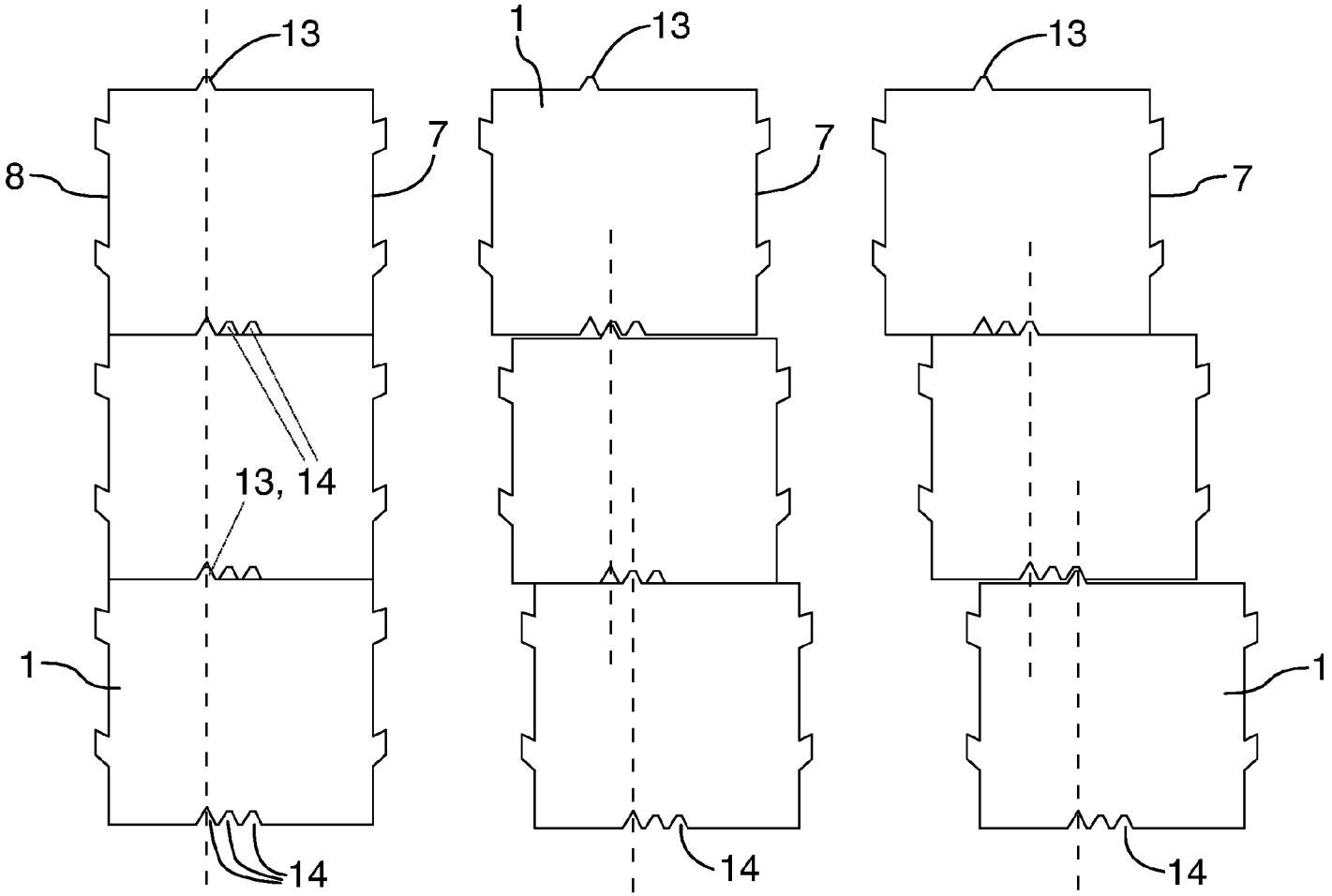
FIGS. 4(*a*), 4(*b*) and 4(*c*) are elevation views of three alternative interlocking of solid core blocks, wherein FIG. 4(*a*) is a vertical non-battered front face.
Figure 14:
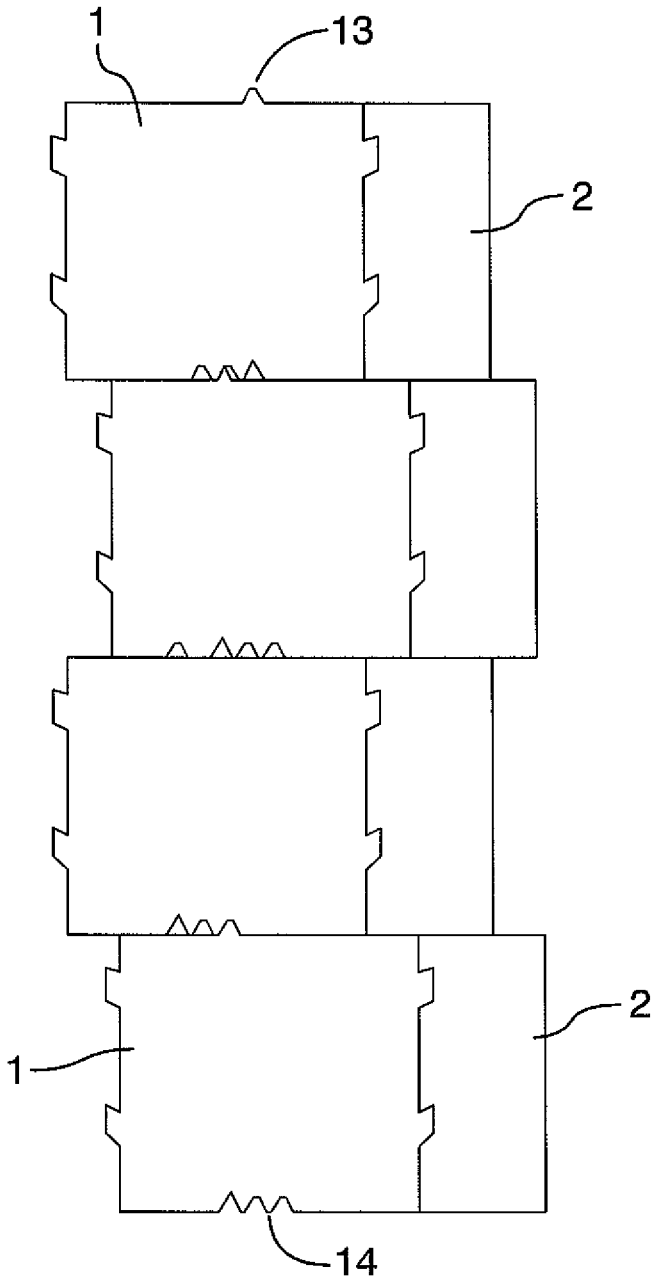
FIG. 14 is a vertical sectional view showing an alternative stacking arrangement to produce a staggered front face for the wall.
Figure 15:
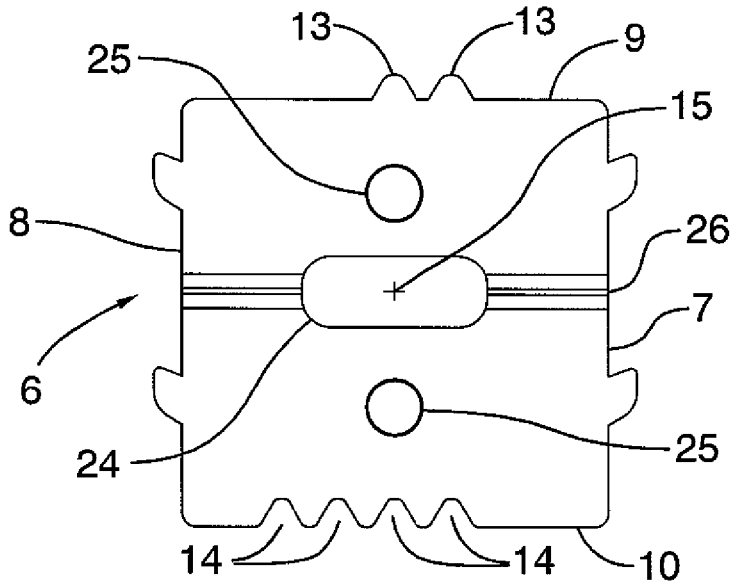
FIG. 15 is an elevation view of the left and right side walls of the second example being a hollow core block of shown in FIG. 16.
Figure 16:
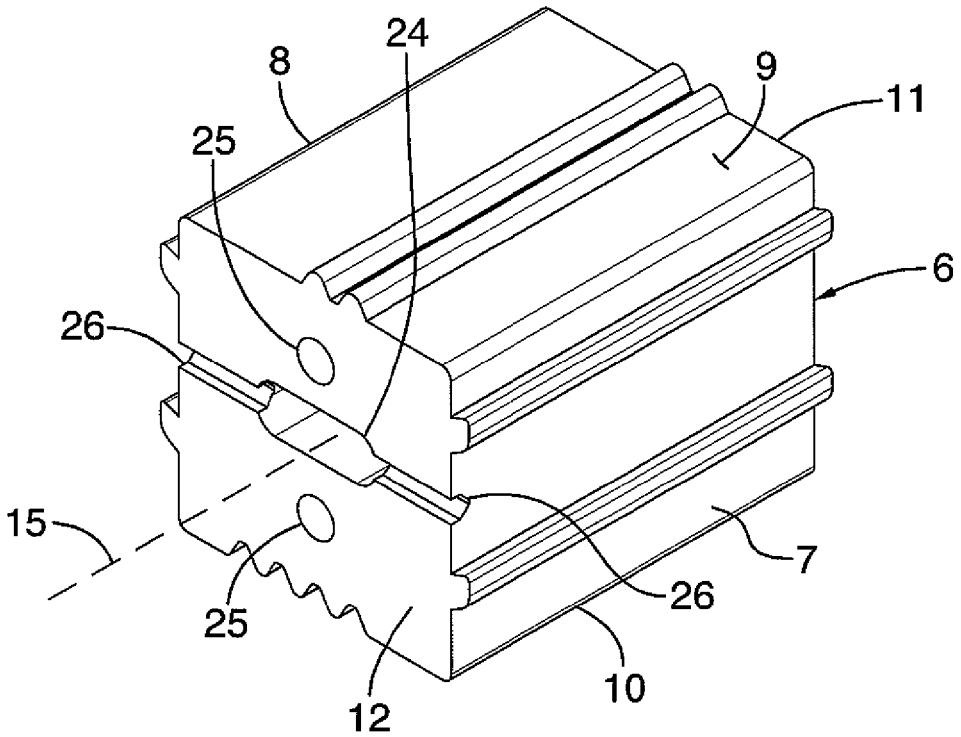
FIG. 16 is an isometric view of the second example hollow core block having an axial oblong passage, and two circular bores.

Each core block 1 has protrusions 13 and grooves 14 in one of the top and bottom faces 9, 10 for interlocking stacked rows of core blocks 1 together. Many variations on the interlocking of rows are possible, such as reversing the location of the protrusion 13 to the bottom face 10. FIGS. 4(*a*)-4(*c*) illustrate the purpose of three grooves 14 when there is a single protrusion 13. By selecting the position of the protrusion 13, the same core block 1 can be used to construct walls of differing batter (i.e. the front wall face slope) as in FIGS. 4(*a*)-4(*c*) from left to right: FIG. 4(*a*) is a vertical non-battered front face; FIG. 4(*b*) is a low batter angle; and FIG. 4(*c*) is a high batter angle. FIGS. 15-16 show the example of a hollow core block 6 having two protrusions 13 in the top face 9 for stacking and interlocking with a selected two of the four grooves 14 in the bottom face 10, which also results in: a vertical non-battered front face; a low batter angle; and a high batter angle. As shown in FIG. 14, a staggered front wall face can be constructed by random selection of the upper core block 1, 6 position relative to an underlying lower core block 1, 6.

Referring to FIGS. 2 and 16, each core block has a slip molding axis 15 and a substantially uniform cross-sectional profile transverse to the slip molding axis 15, wherein the front, rear, top and bottom faces 7, 8, 9, 10 define the cross-sectional profile. Slip molding is an efficient and well established molding procedure for concrete blocks. A high level of accuracy is achieved with slip molding and reliable dimensions within a narrow tolerance are produced which is important for the overall appearance of the stacked wall system. Errors in the positioning of the ledges 4 and recesses 5 would result in lack of alignment of the fascia blocks 2, 3 and a poor finished appearance. Therefore use of highly accurate steel molds that mold the core blocks 1, 6 in an upstanding position, low slump concrete and the reliable proven manufacturing procedures of slip molding ensure accurate dimensions of the core blocks 1, 6 and result in a reliable finished wall appearance.

Figure 19:
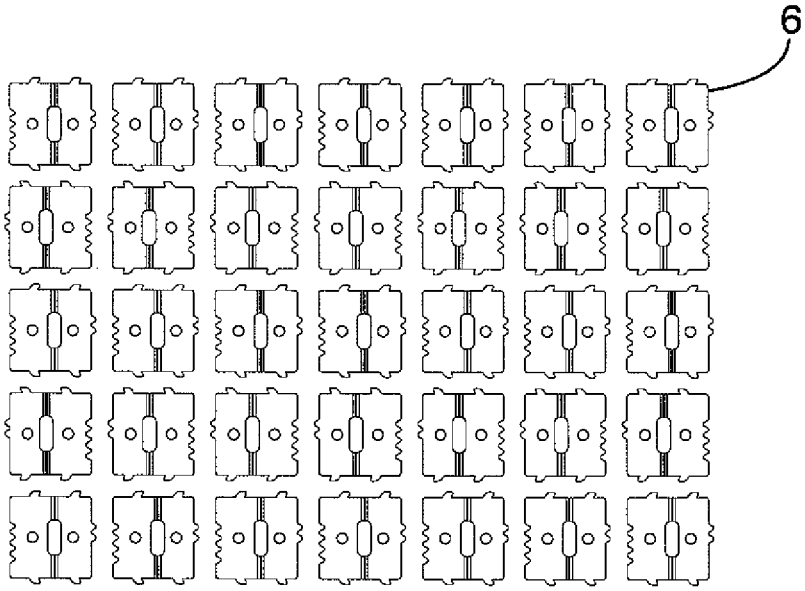
FIG. 19 is a plan view of a nested rack of hollow core blocks as molded with a vertically lifted slip mold, where the mold has been removed.
Figure 20:
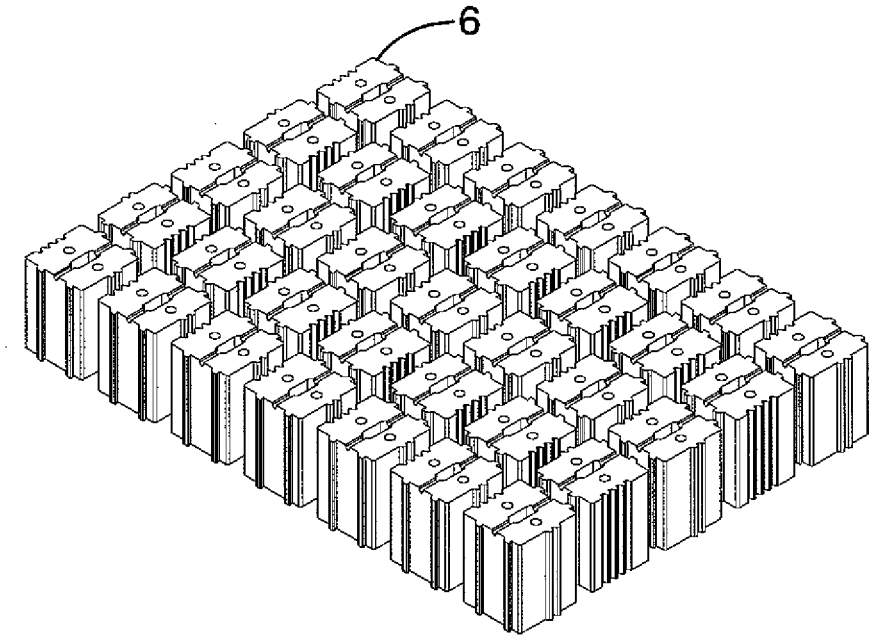
FIG. 20 is an isometric view of the nested rack of hollow core blocks of FIG. 19.
Figure 21:
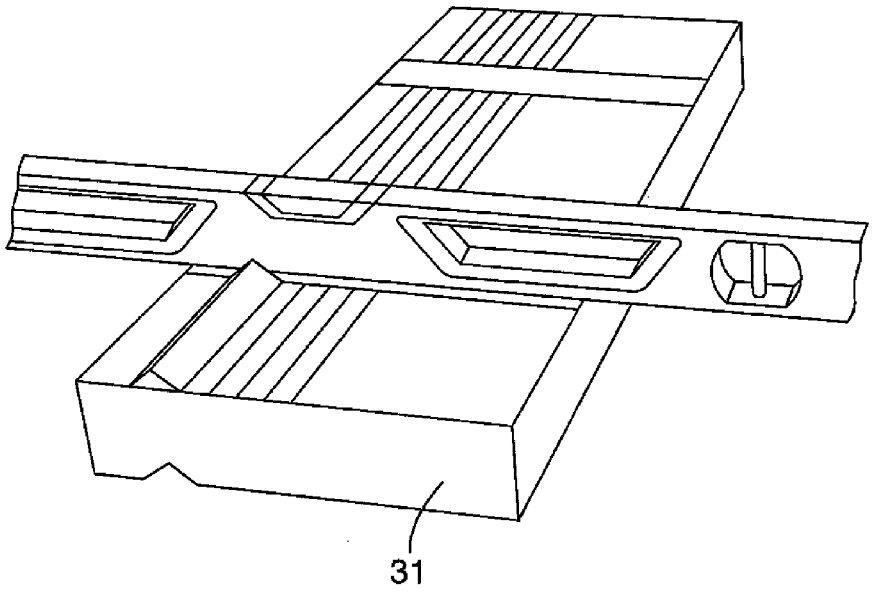
FIG. 21 is a perspective view of a foundation block showing a gap in the ridge to enable a standard level to be positioned transversely.

As shown in the example of FIGS. 19-20, the upstanding position of the core blocks 1, 6 during molding ensures that the cross-sectional shape remains highly accurate. The slip mold axis 15 is vertical during molding and is horizontal when constructed in a wall. The planar left face 11 and right face 12 are molded horizontally with the concrete being poured into the mold from above. Any variation in the volume of concrete or the slump of the concrete or shrinkage after the mold is removed will result in the length dimension (i.e. distance between the left face 11 and right face 12) varying slightly. However such a length variation will be inconsequential when the core blocks 6 are rotated to be stacked laying on their bottom face 10 in a wall construction as in FIG. 1. The cross-sectional dimensions are highly accurate due to the accurate steel mold which ensures that the shape and positioning of the ledges 4 remains accurate.

Conventional blocks may be molded with the upper surface in the same position that the upper surface is placed in a wall construction (i.e. their slip mold axis remains vertical during molding and when installed). The side walls will be accurate since they are formed by a slip mold but the height dimension of a conventional block will vary as a result.

In contrast, the core blocks 1, 6 described herein are molded with upper left face 11 and right face 12 in an upper and lower position, resulting in any significant dimensional variation being in the length dimension which can be easily compensated for in a wall construction. The core blocks 1, 6 can be manufactured using the slip molding process which is conventional, low cost and uses well established procedures.

Figure 5:
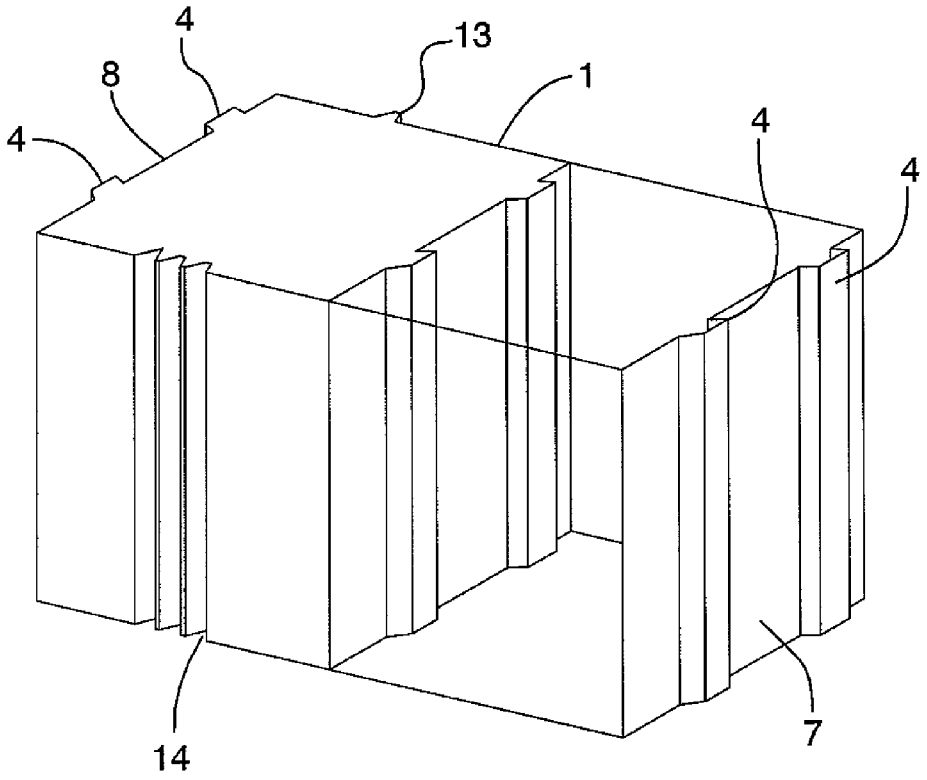
FIG. 5 is an isometric view of the solid core block of FIGS. 1-2 and FIGS. 4(*a*)-4(*c*), in an upturned position as the core block is slip molded and in phantom outline indicating that variation in the solid core block depth is possible to increase mass, increase overturning resistance and hence increase the load resisting capacity of the wall.
Figure 6:
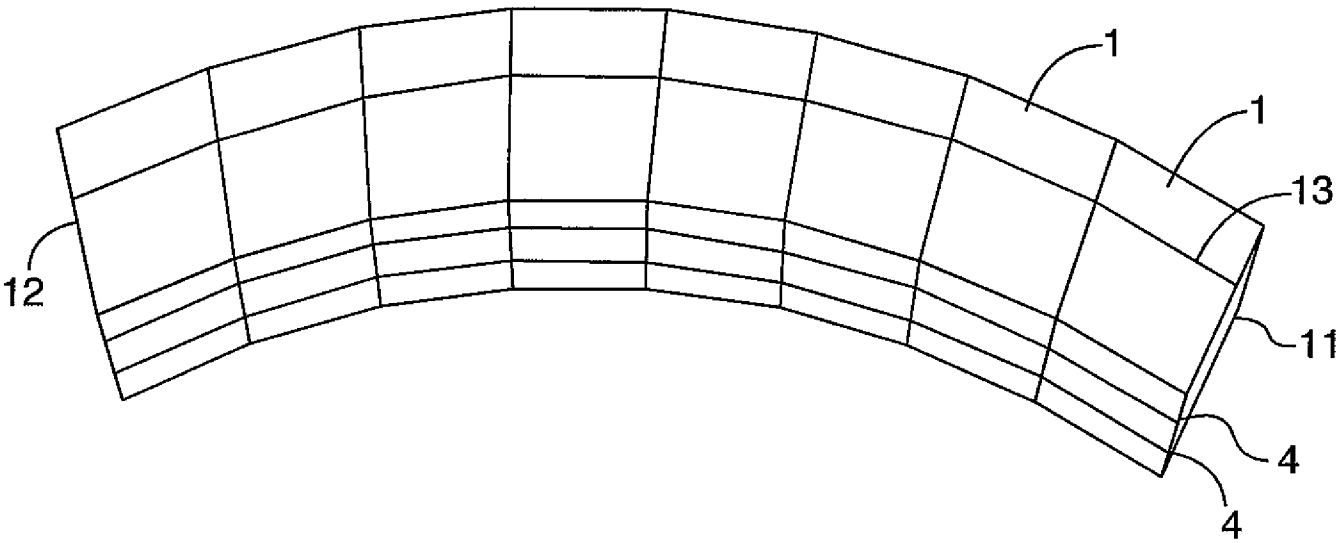
FIG. 6 is a top-isometric view of a row of solid core blocks where the side surfaces are tapered to construct a curved wall.

The core blocks 1, 6 can be easily modified for different requirements. For example FIG. 5 shows that for higher walls a wider core block 1 can be molded with no change in the front and rear faces 7, 8 or to the protrusions 13 and grooves 14. FIG. 6 illustrates the option of molding the side faces 11, 12 of the core blocks 1 at an obtuse angle (greater than 90° but less than 180°) to produce a curved row of core blocks 1. The side faces 11, 12 are molded in the top and bottom position and so molds could be modified to include a bottom wedge shaped insert to produce the angle required. As a result, the left and right side faces 11, 12 of the core blocks 1 are tapered to align the front faces 7 of each core block 1 in a curved assembly when constructed.

The same standard core blocks 1, 6 can be used for supporting many different fascia blocks 2, 3, 22 providing a wall support structure that is compatible with various fascia blocks 2, 3, 22 and also with pavers used on horizontal surfaces. Standardization of the core blocks 1, 6 for use with varying types of fascia blocks 2, 3, 22 leads to lower costs since mold changes can be reduced, production runs can be longer between mold changes, and inventory storage can be reduced.

Figure 3:
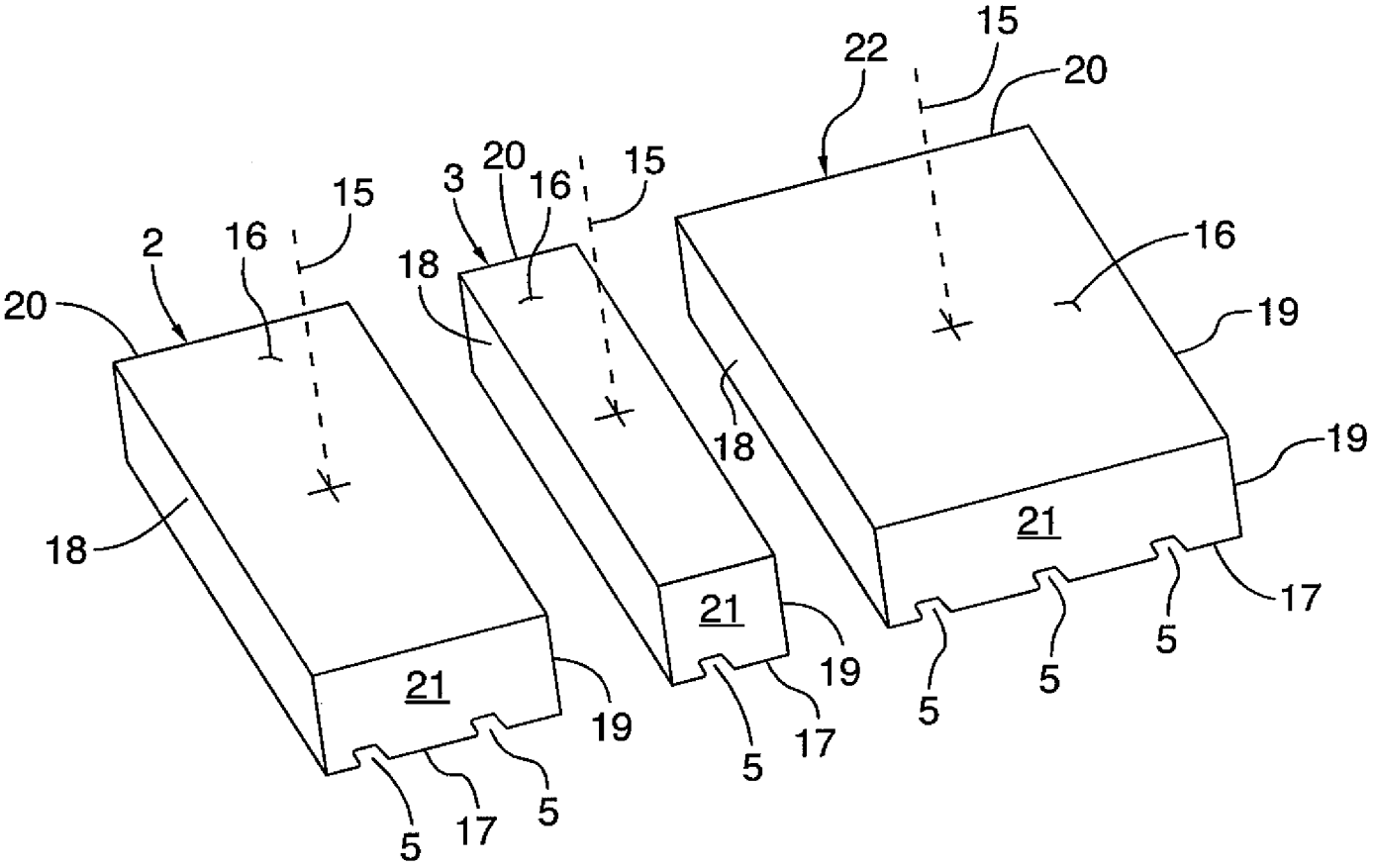
FIG. 3 is a perspective view of the fascia blocks of FIG. 1 having one and two recesses, and a fascia block with three recesses. Any number of recesses can be provided to match the spacing and shape of the ledges of the core blocks on which the recesses are mounted.

Three varieties of possible fascia blocks 2, 3, 22 are illustrated in FIG. 3, namely a wide fascia block 2 with two recesses 5, a thin fascia block 3 with one recess 5, and a triple wide fascia block 22 with three recesses 5. Various patterns can be provided by arranging the different sizes of fascia blocks 2, 3, 22 on the assembled core blocks 1, 6. Each fascia block 2, 3, 22 has: a decorative exposed front face 16; a rear face 17; a top face 18; a bottom face 19; a left side face 20; and a right side face 21. It will be understood that fascia blocks 2, 3, 22 are examples only, and that any number of recesses 5 can be included.

FIGS. 2 and 3 in particular illustrate the means by which fascia blocks 2, 3, 22 are mounted to the assembly of core blocks 1 with connectors. A horizontal ledge 4 protrudes from the front face 7 of the core block 1 in the example illustrated. At least one matching horizontal recess 5 is provided in the rear faces 17 of the fascia blocks 2, 3, 22. Of course the illustrated arrangement could be reversed, namely, a ledge 4 could be provided in the rear faces 17 of the fascia blocks 2, 3, 22 and a recess could be provided in the front face 7 of the core block 1.

Different sizes of fascia blocks 2, 3, 22, as suggested by single, double and triple recess blocks in FIGS. 4(*a*)-4(*c*), can include any number of recesses 5 depending on the block dimensions and spacing of the ledges 4 selected. The recesses 5 shown in the drawings extend between the left and right side faces 20, 21. However if desired the ledges 4 and matching recesses 5 can be intermittent in the horizontal direction to completely hide the ledges 4 and recesses 5 in the finished wall appearance.

Figure 7:
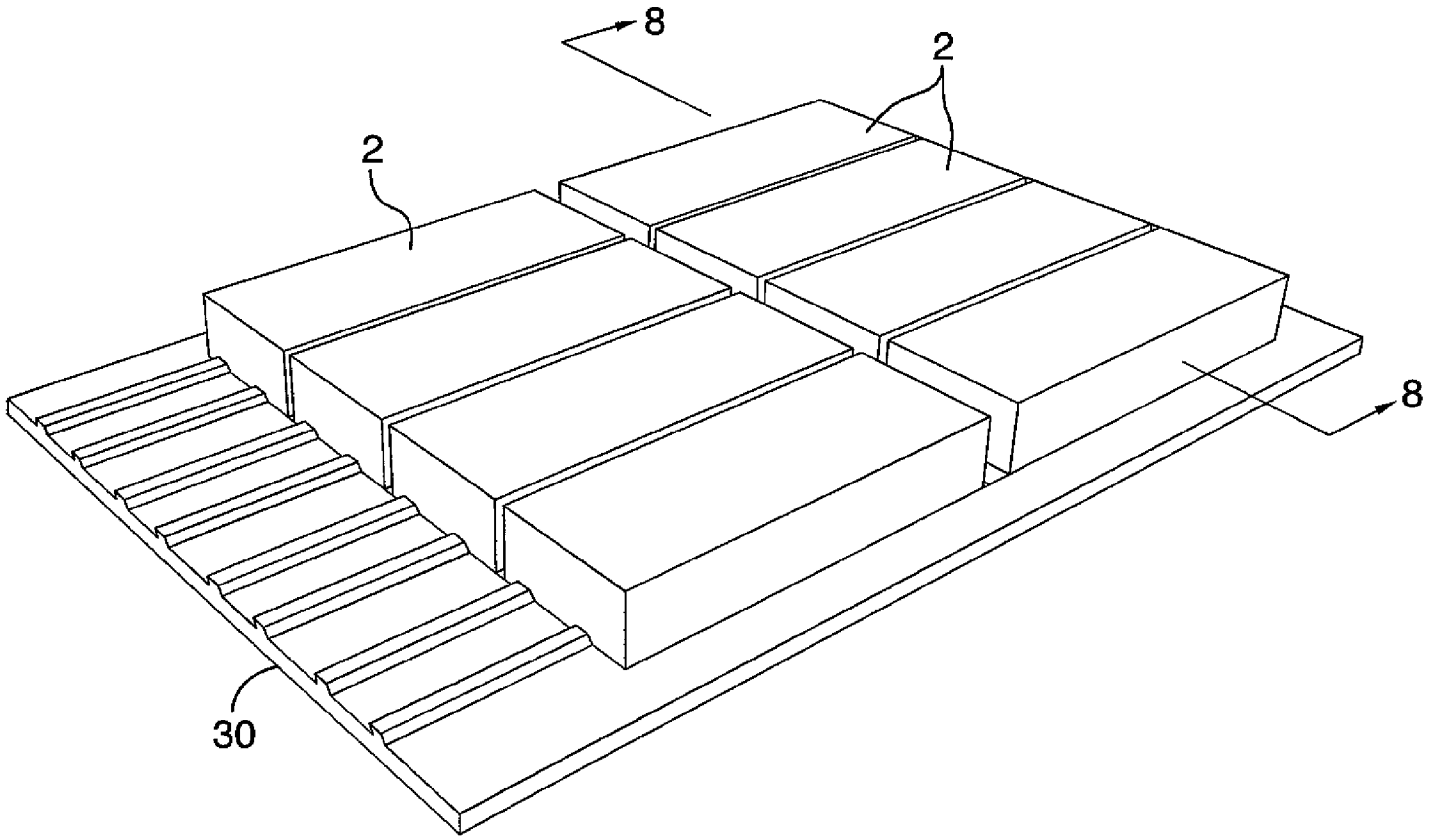
FIG. 7 is an isometric view of fascia blocks molded on a bottom plate that forms the two recesses with the top filled mold removed.
Figure 8:
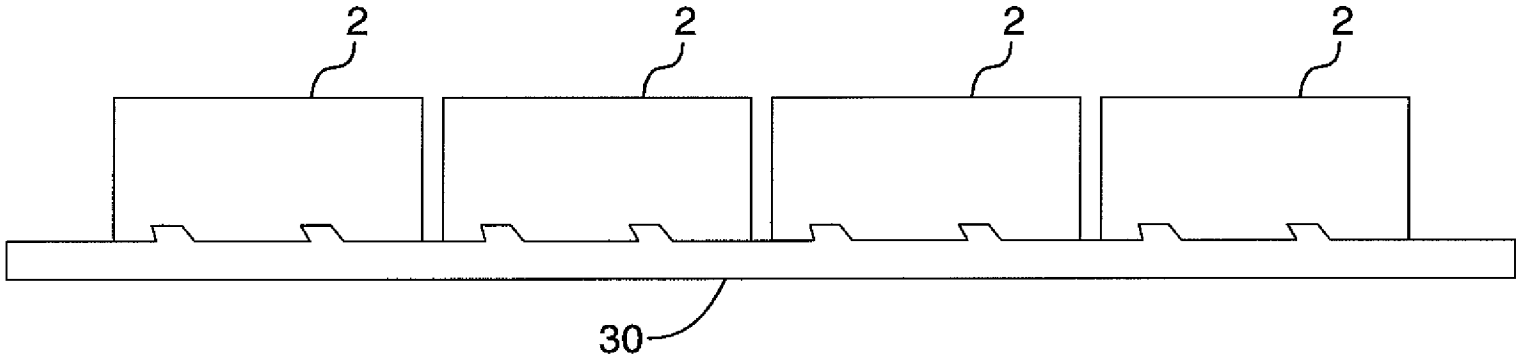
FIG. 8 is a sectional view along line 8-8 of FIG. 7.

FIGS. 7-8 illustrate one method of molding the fascia block 2 with two recesses. The fascia blocks 2 are molded on a bottom plate 30 that forms the two recesses 5. A top filled mold (not shown) forms the vertical lateral walls and is removed by sliding vertically. The bottom plate 30 is removed by sliding the fascia blocks 2 laterally once the concrete material has set sufficiently.

Referring to FIGS. 4(*a*)-4(*c*), those familiar with the manufacture of paver blocks will recognize that the fascia blocks 2, 3, 22 can be manufactured in a like manner, with the same molding equipment and can include many modifications to the exposed decorative front face 16 that are found in pavers. For example the front face 16 and faces 18-21 may be molded to imitate natural stone using flexible rubber molds and wet casting methods. Color treatments, coatings and surface abrasion methods used to produce unique paver products can be applied to the fascia blocks 2, 3, 22 so that the fascia blocks 2, 3, 22 match or complement pavers used in adjacent paved surfaces.

The fascia blocks 2, 3, 22 may be manufactured like paver blocks in a slip mold process using dry pack or low slump concrete methods where the exposed front face 16 is disposed upwardly during mold filling, molding and subsequent processing. In such a case, each fascia block 2, 3, 22 has a slip molding axis 15 positioned vertically during molding which produces a substantially uniform cross-sectional profile transverse to the slip molding axis 15. The left and right side faces 20, 21, the top and bottom faces 18, 19 define the cross-sectional profile.

The wall system shown in FIG. 1 has a core block height that is a multiple of the fascia block height. Specifically the core block 1 has a height equal to the height of the wide fascia block 2 and twice the height of the thin fascia block 3. Referring to FIG. 3, the core block 1 has a height that is a fraction (⅔) of the height of the triple fascia block 22. Any combination of multiple and fractional heights can be provided in a like manner by selecting a standard set of block module dimensions.

The horizontal ledge 4 shown in the drawings has a rearward sloping upper surface and together with the matching sloping surface of the recess 5, serves to urge the fascia blocks 2, 3 under the force of gravity towards engagement with the core blocks 1. The rearward sloping surface of the ledge 4 also retains viscous fluid adhesive or adhesive caulking strips that can be used to secure the fascia blocks 2, 3. When fascia blocks 2, 3 are stacked and mounted on the ledges 4, the sloping surfaces and abutting horizontal fascia block surfaces also prevent accidental removal of the fascia blocks 2, 3 and vandalism damage. Slight inaccuracies in the forming of the ledges 4 or breakage of ledges 4 during handling can be addressed during construction of a wall by using shims, chiseling away any excess material, and using adhesives. For example a slight misalignment of adjacent ledges 4 can be dealt with by removing an end part of one ledge 4 and using the fascia block 2 to bridge over the removed portion of the ledge 4. The alignment of the fascia blocks 2, 3, 22 can be adjusted during assembly of the wall using shims on the ledges 4, removing part of the ledges 4 with a chisel and applying adhesives if the core blocks 1 are slightly misaligned when stacked or have minor damage to the ledges 4.

As illustrated in the example of FIG. 1, the assembled wall of core blocks 1 each has a front face 7 with two horizontal ledges 4 and the vertical spacing of ledges 4 is selected so that are equally spaced apart vertically. This arrangement permits flexibility in the design and appearance as suggested by FIG. 1. Equal spacing of ledges 4 on a flat front surface permits the core blocks 1 to be completely assembled as a support structure before fascia blocks 2, 3 are installed. The choice of different sized fascia blocks 2, 3, 22 as shown in FIG. 3 having different height, length, width, color or textures can produce patterns and designs with a high degree of flexibility and variety. FIG. 1 shows a thin fascia block 3 that forms a band. A fascia block 3 of relatively lower width would form a recessed band or shadow reveal effect. Fascia blocks 2, 3, 22 can be molded to include letters, symbols, crests, or sculptural effects, supported on the ledges 4 of the core blocks 1. Fascia blocks 2, 3, 22 can be molded from concrete, plastic, rubber or many other materials. Fascia blocks 2, 3, 22 are very simple in shape which can be cut from slabs of natural stone and the recesses in natural stone can be sawn, routered, ground or otherwise machined to the approximate shape illustrated.

The example shown in FIG. 1, and in side view of FIG. 4(*a*) is where the protrusions 13 and grooves 14 in the top and bottom faces 9, 10 of the core blocks 1 are aligned vertically (dashed line in FIG. 4(*a*)) to align the front faces 7 of each core block 1 in the assembly in a vertical plane.

An option provided by a vertical structure (FIGS. 1 and 4(*a*)) is that fascia blocks 2, 3, 22 can be mounted to the front faces 7 and also to the rear faces 8 of each core block 1, as in FIGS. 10-11, if mounting ledges 4 are also provided on the rear face 8. FIGS. 10-11 show a wall that has fascia blocks 2 mounted on the front and rear sides of the solid core blocks 1. The use of a narrow fascia block 3 at the base provides an overlapping or straddling of horizontal joints between the core blocks 1 by the wider fascia blocks 2 as seen in FIGS. 10-11. The vertical joints between the core blocks 1 are also overlapped by the fascia blocks 2, 3. The overlapping of joints enhances the structural strength of the wall and resistance to overturning. A foundation block 31 is placed first on a prepared subsurface of compacted crushed stone for example, and a coping block 32 is placed on the top of the wall. Both the foundation block 31 and the coping block 32 can be manufactured to be identical as shown in FIG. 11.

Figure 9:
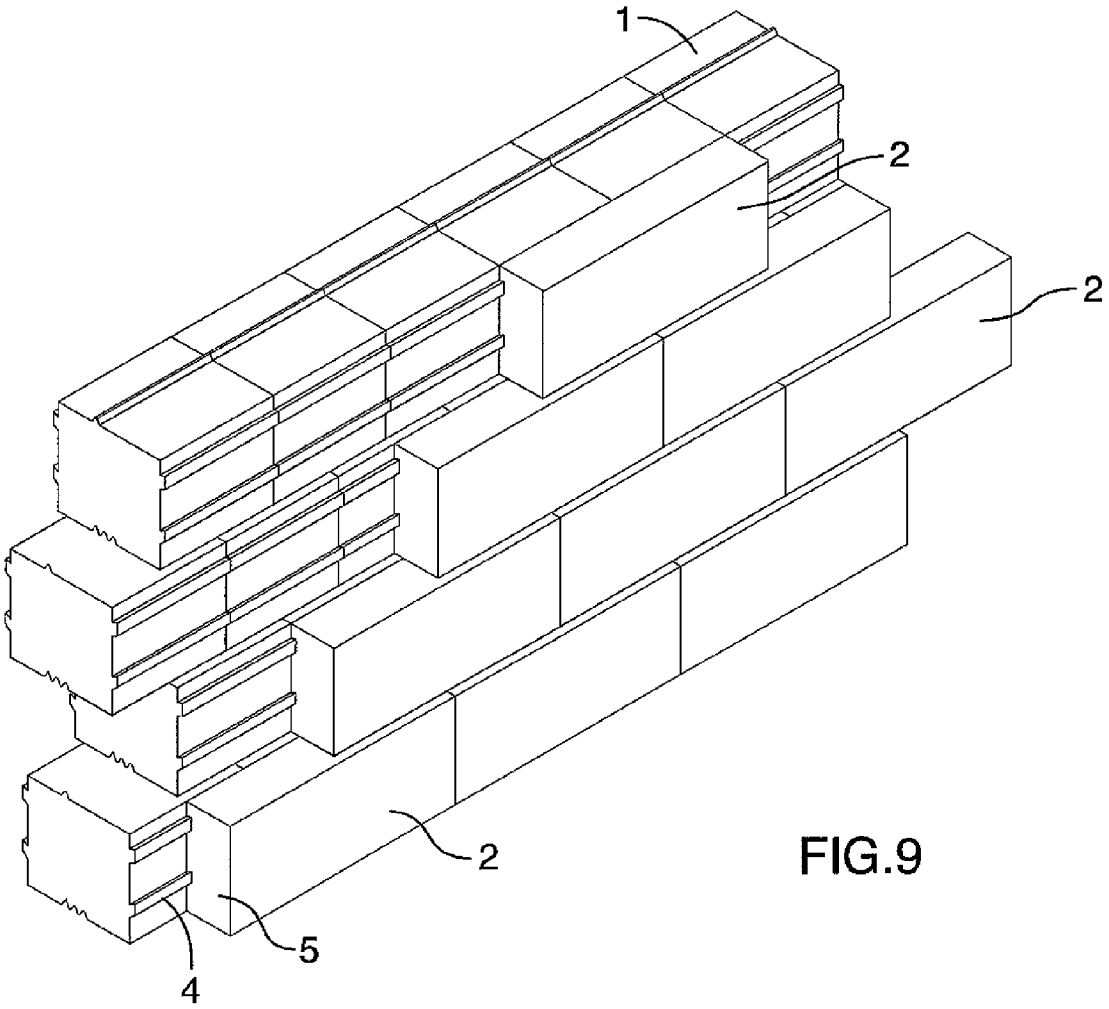
FIG. 9 is perspective view of an example wall, in accordance with an embodiment of the invention, constructed of solid core blocks and a single size of fascia blocks with a battered exposed front face (i.e.: each stacked row is stepped back to produce a sloped front face).
Figure 12:
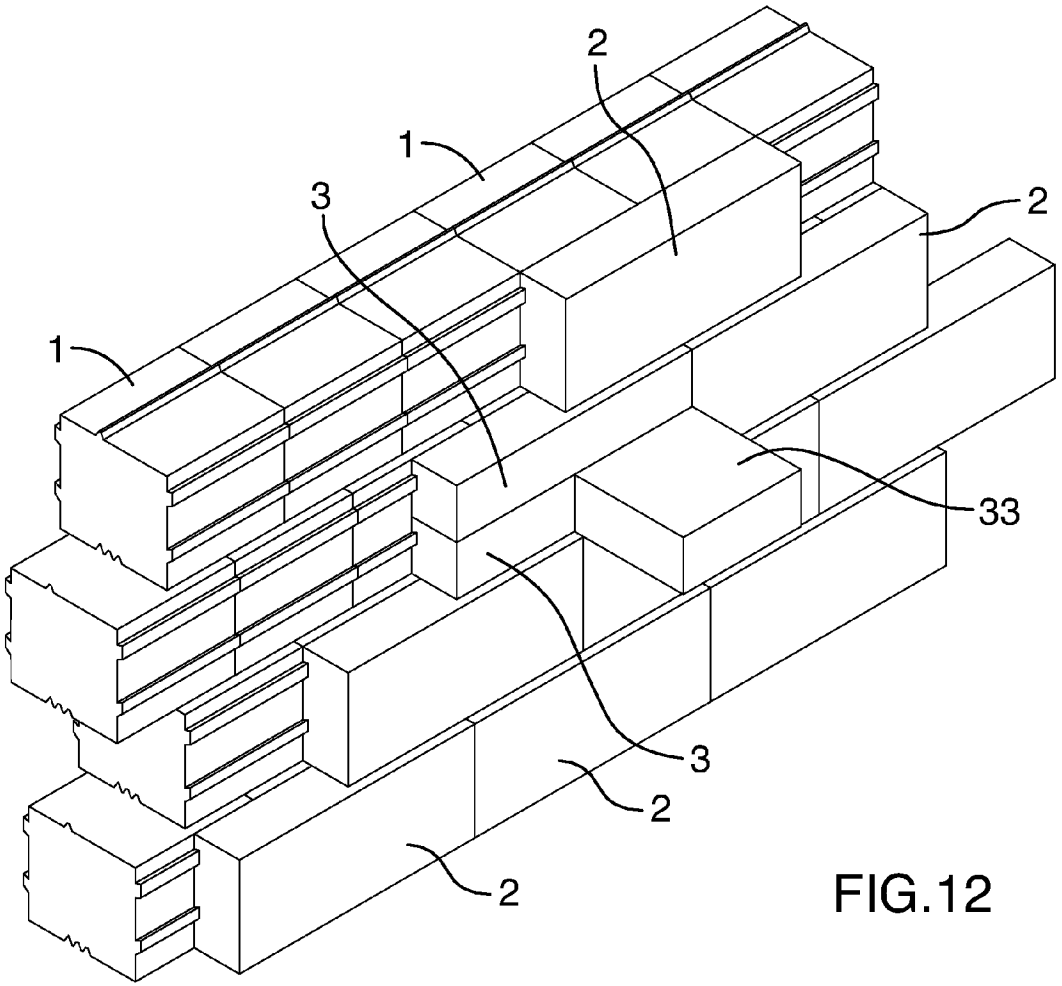
FIG. 12 is a perspective view of an example wall with a battered front face like FIG. 9 but with the addition of a shelf block incorporated into the assembly of fascia blocks.
Figure 13:
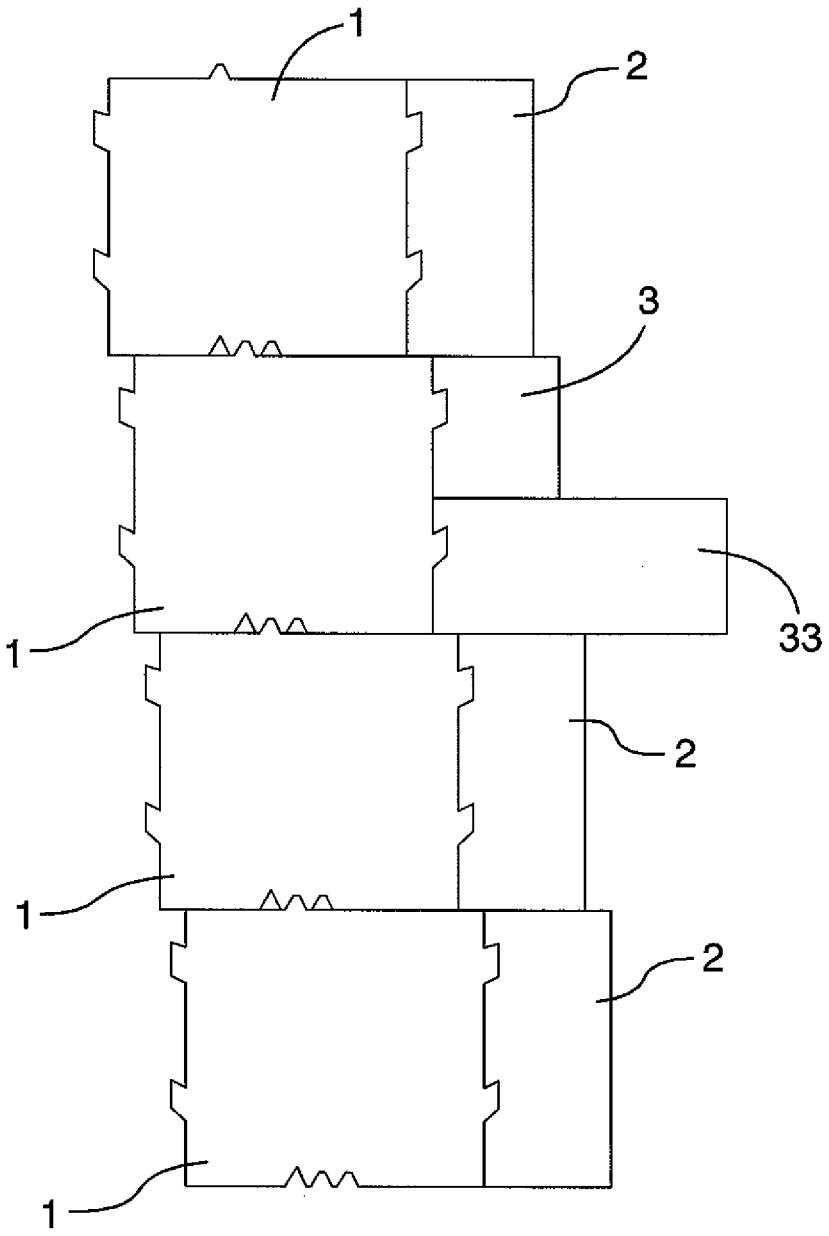
FIG. 13 is a vertical sectional view through the wall of FIG. 12 showing the shelf block.

The example shown in FIG. 9 and in side view of FIG. 4(*b*)-4(*c*) is where the protrusions 13 and grooves 14 in the top and bottom faces 9, 10 of the core blocks 1 are offset rearwardly to align the front faces 7 of each core block 1 in a battered assembly. The same battered front wall is illustrated in FIG. 12-13 with the option of a shelf block 33 assembled in the same manner as the adjacent fascia blocks 2, 3.

Illustrated in FIG. 14 is an option wherein the protrusions 13 and grooves 14 are offset rearwardly and forwardly in a random pattern to align the front faces of each core block 1 in a staggered assembly with adjacent blocks 1 being in or out relative to blocks above, below or on either side. Selection of fascia blocks 2, 3, 22 with appropriate dimensions to follow the battered or staggered core blocks 1 is necessary in such cases, whereas in a vertical wall in FIG. 1, the selection of fascia block 2, 3, 22 dimensions is independent of the supporting core block 1 dimensions.

A structural advantage of the wall system shown in FIG. 1 is that the fascia blocks 2, 3 can be mounted to span across the vertical and horizontal joints between adjacent core blocks 1. Especially when secured with adhesives, the wall structure is reinforced by the spanning of joints or overlapping of the fascia blocks 2, 3. For example, in FIG. 1 all fascia blocks 2, 3 span across vertical joints between the core blocks 1. Due to the thin height of the thin fascia blocks 3, the overlaying fascia block 23 spans over the horizontal joint between core blocks as well as the vertical joints. The height and length dimensions of fascia blocks 2, 3, 22 can be selected to provide overlapping of the core block joints if desired.

Figure 17:
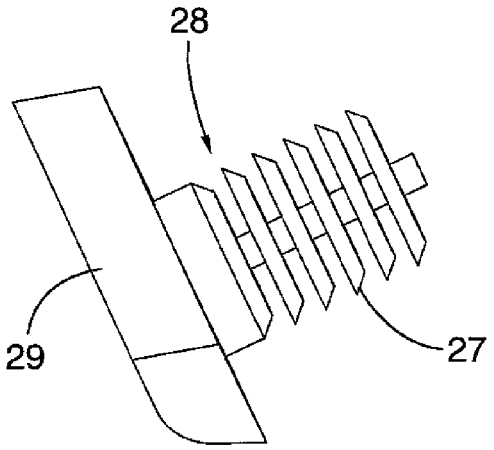
FIG. 17 is an isometric view of a ledge pin for supporting a fascia block shown in FIG. 11.
Figure 18:
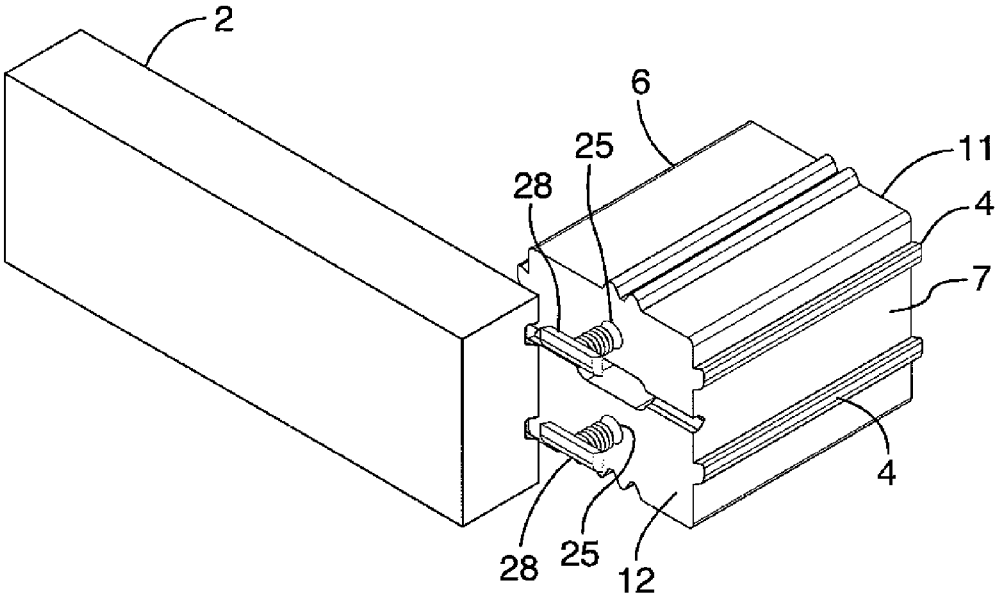
FIG. 18 is an isometric exploded view of a hollow core block and ledge pin showing the corner mounting detail of a fascia block.

Reference is made to the second example of core blocks 6 shown in FIGS. 15-16. These core blocks 6 can be aligned in a stacked row where each core block 6 has a hollow channel 24 extending between their left and right side faces 11, 12 thereby defining a horizontal passageway for one of: electrical wires; water pipes; drainage pipes; and gas pipes. Additional bores 25 can be provided to mount fascia blocks as shown in FIGS. 17-18, to further reduce the weight, or insert additional utilities. Lateral channels 26 provide a passage for wires or pipes to extend to the front face 7 or rear face 8 along the vertical joints between stacked core blocks 6. FIGS. 19-20 illustrate the core blocks 6 as molded with the slip mold axis 15 vertical. Inserts to form the channels 24-25 are raised with the slip mold along the slip mold axis 15.

As shown in FIGS. 17-18, when walls include inside or outside corners, stairs or exposed ends, fascia blocks 2 can be mounted to the left and right side faces 11, 12 of the core block 6. The left and right sides 11, 12 of the core block 6 include at least one bore 25 into which the shaft 27 of a ledge pin 28 can be inserted. The ledge pin 28 has a head 29 having the same shape as the ledge 4 forming a fascia block supporting ledge. The ledge pin 28 can be molded from any suitable outdoor resistant material such as plastic or neoprene.

The wall system can include specialized fascia blocks such as: a shelf block 33; a planter block; an electrical outlet socket block; and a lighting socket block, that are mounted in the same manner on ledges 4 or ledge pins 28.

As described above, advantages of the wall system include as follows:

the surface treatments and specialized molding techniques used on pavers can be incorporated into a wall design by using fascia blocks 2, 3, 22 manufactured in the same manner as pavers;

vertical, battered or staggered wall surfaces can be produced using the same core blocks 1, 6 and fascia blocks 2, 3, 22;

banding designs of fascia blocks 2, 3, 22 (FIG. 1) with alternate textures and colors is easily produced;

varying fascia block 2, 3, 22 heights and widths are accommodated with spaced apart ledges 4 on the core blocks 4;

fascia blocks 2, 3, 22 can be recessed or battered to produce shadow or reveal effects;

fascia blocks are simple to mount on horizontal ledges 4 without mechanical fasteners, apart from corner mounted fascia blocks which use ledge pins 28 on side walls;

fascia blocks 2, 3, 22 can be used to produce wall surfaces that are compatible with pavers;

core blocks 1, 6 are accurately molded, low cost and manufacturing is efficient using existing equipment;

core blocks 1, 6 can be made in different widths for structural walls of different heights double sided seat walls, residential and commercial (indoor or outdoor) fences, partitions and walls built of core blocks and fascia blocks can include hollow tunnels or passages for installing utilities; and when used for a landscaping retaining wall or planter, there is very little, if any, transference of efflorescence from the retained soil to the outside face of the fascia blocks.

Although the above description relates to a specific preferred embodiment as presently contemplated by the inventors, it will be understood that the invention in its broad aspect includes mechanical and functional equivalents of the elements described herein.

Having described the invention, the following is claimed:

1. A wall system, for landscape applications, indoor or outdoor privacy walls, privacy fences, mortar-less masonry walls, residential and commercial sound barriers, the wall system comprising:

a plurality of core blocks, each core block having: a front face; a rear face; a top face; a bottom face; a left side face; and a right side face, each core block having protrusions and grooves the top and bottom faces for interlocking the core blocks together in stacked rows with adjacent side faces, each core block having a slip molding axis and a uniform cross-sectional profile transverse to the slip molding axis, wherein the front, rear, top and bottom faces define the core cross-sectional profile;

a plurality of fascia blocks, each fascia block having: a decorative exposed front face; a rear face; a top face; a bottom face; a left side face; and a right side face, wherein each fascia block has a slip molding axis and a uniform cross-sectional profile transverse to the slip molding axis, wherein the left and right side faces, the top and bottom faces define the fascia cross-sectional profile, and wherein each fascia block has a center of gravity located at an eccentric distance from the rear face;

a plurality of connectors for supporting stacked rows of the fascia blocks suspended on one of: the front faces; and the rear faces of the stacked rows of core blocks, the connectors comprising:

a horizontal ledge having a downward sloping surface, the horizontal ledge protruding from one of: the rear face of the fascia blocks; and the front face of the core blocks; and a matching horizontal recess having a downward sloping surface, the horizontal recess disposed in one of: the front face of the core blocks; and the rear face of the fascia block, wherein the fascia blocks are each supported by their rear faces, by engagement of the downward sloping surfaces of the horizontal ledge and the matching horizontal recess, and the rear face of each fascia block is rotated into contact with the front face of the core blocks, by the force of gravity acting on each fascia block through said center of gravity located at said eccentric distance from the rear face.

2. The wall system according to claim 1, wherein the front face of the core block includes two or more horizontal ledges.

3. The wall system according to claim 1, wherein at least one of the fascia blocks is mounted to span across a vertical joint between adjacent core blocks and to span across a horizontal joint between adjacent core blocks.

4. The wall system according to claim 1, wherein the core block has at least one hollow channel extending between the left and right side faces.

5. The wall system according to claim 1, wherein the rear face of the fascia block includes two or more horizontal recesses.

6. The wall system according to claim 1, wherein the rear face of the fascia block includes at least one horizontal recess extending between the left and right side faces.

7. The wall system according to claim 1 wherein one of the left and right sides of the core block includes a bore, the wall system comprising a ledge pin having a shaft inserted in the bore and a head having a fascia block supporting ledge.

8. The wall system according to claim 1, wherein the protrusions and grooves in the top and bottom faces of the core blocks are aligned vertically to align the front faces of each core block in the assembly in a vertical plane.

9. The wall system according to claim 8, wherein the rear faces of each core block in the assembly are aligned in a vertical plane, and wherein fascia blocks are mounted to the front and rear faces of each core block.

10. The wall system according to claim 1, wherein the horizontal ledge includes at least two horizontal ledges and the horizontal recess includes at least two horizontal recesses, the protrusions and grooves in the top and bottom faces of the core blocks in each vertically adjacent row are offset rearwardly to align the front faces of each core block in a battered assembly.

11. The wall system according to claim 1, wherein the protrusions and grooves in the top and bottom faces of the core blocks are offset rearwardly and forwardly to align the front faces of each core block in a staggered assembly.

12. The wall system according to claim 1, wherein the left and ride side faces of the core blocks are tapered to align the front faces of each core block in a curved assembly.

13. The wall system according to claim 1, wherein at least one of the fascia blocks is mounted to span across a vertical joint between adjacent core blocks.

14. The wall system according to claim 1, wherein at least one of the fascia blocks is mounted to span across a horizontal joint between adjacent core blocks.

15. The wall system according to claim 1, wherein the core blocks in a stacked row each have a hollow channel extending between their left and right side faces thereby defining a horizontal passageway for one of: electrical wires; water pipes; drainage pipes; and gas pipes.

16. The wall system according to claim 1, wherein the fascia blocks include one of: a shelf block; a planter block; an electrical outlet socket block; and a lighting socket block.

17. The wall system according to claim 1 having a minimum block height dimension, wherein each core block has a core block height and each fascia block has a fascia block height that are a whole number multiplied by the minimum block height dimension.

18. The wall system according to claim 17, wherein one of: the horizontal ledges; and the horizontal recesses, are vertically spaced apart by the minimum block height dimension when the core blocks are interlocked together in stacked rows.

* * * * *